US006126585A

United States Patent [19]

Norwood et al.

[11] Patent Number: 6,126,585

[45] Date of Patent: Oct. 3, 2000

[54] APPARATUS AND METHOD TO LUBRICATE AND CURL PAPERBOARD CONTAINER RIMS

[75] Inventors: David W. Norwood, Joppatowne; Robert Brown, Glen Burnie; Edward Earnest, Owings Mills, all of Md.

[73] Assignee: Sweetheart Cup Company, Inc., Owings Mills, Md.

[21] Appl. No.: 08/458,783

[22] Filed: Jun. 2, 1995

[51] Int. Cl.[7] ..... B31B 49/02

[52] U.S. Cl. ..... 493/159; 493/107; 493/109; 493/149

[58] Field of Search ..... 72/43, 44, 45; 493/105, 106, 107, 108, 109, 148, 149, 158, 159, 328, 330

[56] References Cited

U.S. PATENT DOCUMENTS

| | | | |
|---|---|---|---|
| 2,117,295 | 5/1938 | Buckingham | 493/106 |
| 2,169,580 | 9/1939 | Conway . | |
| 2,821,156 | 1/1958 | Lyon | 72/43 |
| 3,028,798 | 4/1962 | Allen . | |
| 3,087,390 | 4/1963 | Ruza | 493/327 |
| 3,162,268 | 12/1964 | Short . | |
| 3,336,847 | 8/1967 | Durat . | |
| 3,547,012 | 12/1970 | Amberg et al. . | |
| 4,046,225 | 9/1977 | Shenk . | |
| 4,204,462 | 5/1980 | Richards et al. . | |
| 4,243,079 | 1/1981 | Daniels | 141/1 |
| 4,408,688 | 10/1983 | Bieri . | |
| 4,536,173 | 8/1985 | Puls . | |
| 4,836,335 | 6/1989 | Ishida et al. . | |
| 4,935,091 | 6/1990 | Cress et al. . | |

*Primary Examiner*—David A. Scherbel
*Assistant Examiner*—Anthony Ojini
*Attorney, Agent, or Firm*—Nixon & Vanderhye P.C.

[57] ABSTRACT

Apparatus for lubricating and curling a rim of a paperboard container includes a housing block defining a central recess sized and configured to accept therein a rim of a paperboard container to be curled. An annular curling channel is disposed in the recess for curling the rim of the paperboard container in response to relative advancing movement between the paperboard container and the housing block. The housing block also defines an annular liquid channel concentrically disposed in surrounding relationship to the annular curling channel for distributing lubricating liquid. A porous liquid transfer ring is attached to the housing block in covering relationship to the annular liquid channel so that lubricating liquid supplied to the liquid channel comes into contact with the liquid transfer ring. The liquid transfer ring includes a circular edge surface which defines a central opening such that the liquid transfer ring extends at least partially over the curling channel. In use, the rim of the paperboard container comes into wiping contact with the central opening of the liquid transfer ring so that lubricating liquid is transferred thereto prior to the rim being curled in the curling channel.

17 Claims, 2 Drawing Sheets

APPARATUS AND METHOD TO LUBRICATE AND CURL PAPERBOARD CONTAINER RIMS

FIELD OF INVENTION

The present invention relates generally to conversion of paperboard to useful products, e.g., containers such as drinking cups. More specifically, the present invention relates to apparatus and methods to lubricate and curl paper container rims, especially the bottom rim of a paperboard container.

BACKGROUND AND SUMMARY OF THE INVENTION

Paperboard containers (e.g., drinking cups) are typically formed with a generally conically-shaped tubular side wall and a bottom wall. The bottom wall is joined to the side wall by gluing and by rolling or curling a bottom rim of the side wall over the bottom wall so that the side and bottom walls form a substantially liquid tight (i.e., leak-proof) annular seam.

As may be appreciated, this curling of the bottom rim of the container side wall is a stressful operation on the paperboard. That is, curling of the bottom rim can cause damage to occur to printed indicia or protective coatings that may be on the side wall resulting in the manufacture of a container which is not suitable for commercial sale. To overcome this problem, it has been conventional practice to lubricate the bottom of the container before curling with a food-grade lubricating mineral oil using a spray tool. The lubricated container bottom is then brought into contact with a rotating curling tool.

However, spraying of the lubricant onto the container bottom has several disadvantages such as contaminating the container-forming equipment and other containers with overspray as well as applying excessive amounts of the lubricant to the containers (which could damage the appearance of the finished container product). Moreover, use of a high speed rotating curling tool has the disadvantage of generating excessive heat which could damage the container (e.g., coatings applied to the container side wall).

It would therefore be especially desirable if the bottom side wall rim of a paperboard container could be concurrently lubricated and curled without using spray techniques or a rotating curling tool. It is towards fulfilling such needs that the present invention is directed.

Broadly, therefore, the present invention is embodied in apparatus and method for concurrently lubricating and curling a rim of a paperboard container. The preferred embodiment of the rim lubricating and curling apparatus includes a housing block defining a central recess sized and configured to accept therein a rim of a paperboard container to be curled. An annular curling channel is disposed in the recess for curling the rim of the paperboard container in response to relative advancing movement between the paperboard container and the housing block. The housing block also defines an annular liquid channel concentrically disposed in surrounding relationship to the annular curling channel for distributing lubricating liquid. A porous liquid transfer ring is attached to the housing block in covering relationship to the annular liquid channel so that lubricating liquid supplied to the liquid channel comes into wiping contact with the liquid transfer ring.

The liquid transfer ring includes a circular edge surface which defines a central opening which is sized such that the liquid transfer ring extends at least partially over the curling channel. In use, the rim of the paperboard container comes into wiping contact with the central opening of the liquid transfer ring so that lubricating liquid is transferred thereto prior to the rim being curled in the curling channel.

Further aspects and advantages of this invention will become more clear after careful consideration is given to the detailed description of the preferred exemplary embodiments thereof which follows.

BRIEF DESCRIPTION OF THE ACCOMPANYING DRAWINGS

Reference will hereinafter be made to the accompanying drawings wherein like reference numerals throughout the various FIGURES denote like structural elements, and wherein.

DETAILED DESCRIPTION OF THE PREFERRED EXEMPLARY EMBODIMENTS

Figure 1:
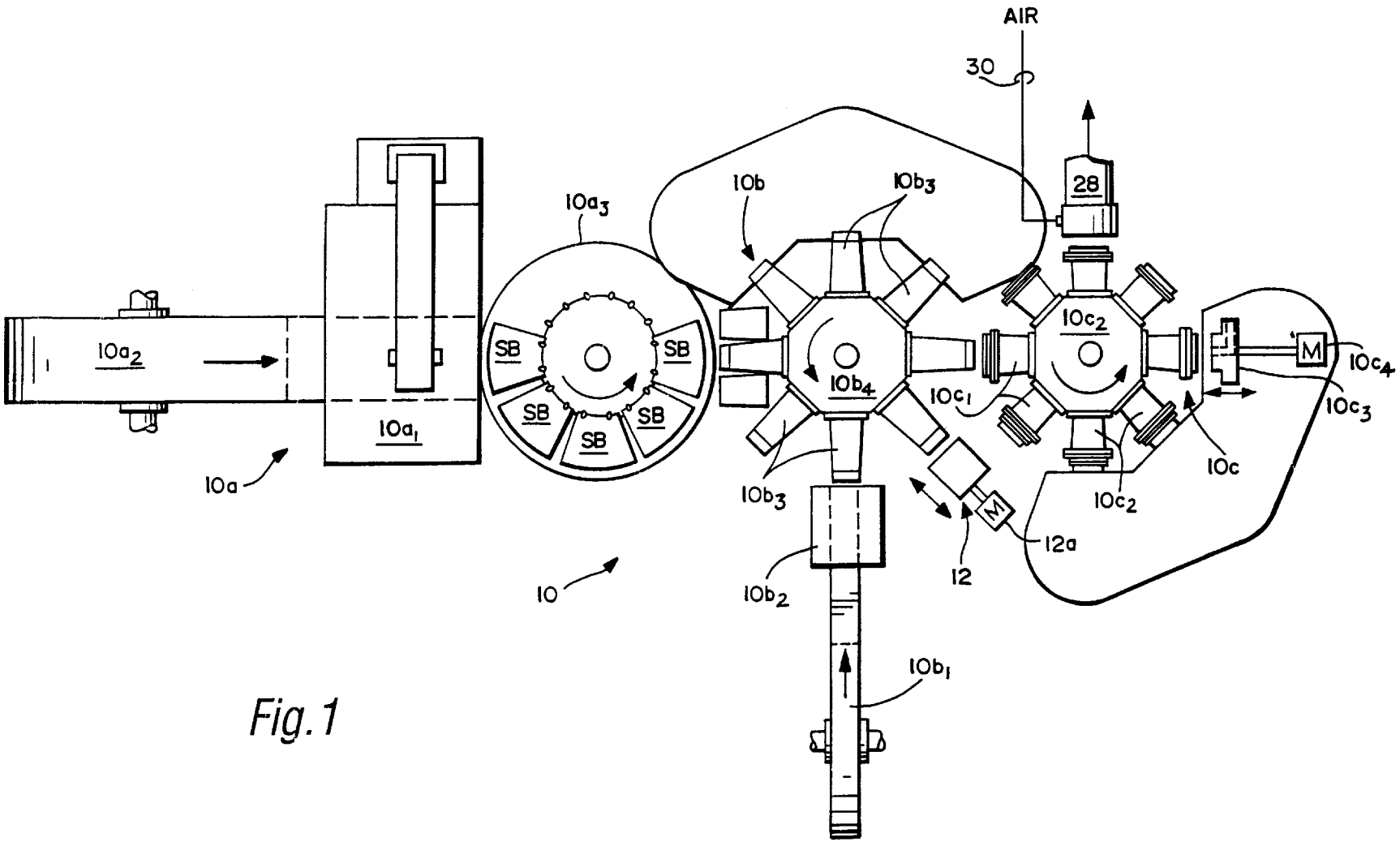
FIG. 1 is a schematic top plan view of a container-making machine which includes a container curling tool according to the present invention.

Accompanying FIG. 1 depicts in schematic fashion a container-making machine 10 for making containers from paperboard sheet stock that employs a curling tool 12 according to this invention for concurrently lubricating and curling the bottom side wall rim of a container during its manufacture. In this regard, the container making machine 10 which is suitable for use in conjunction with the curling tool 12 is in and of itself conventional in that it includes a side wall blank-forming station 10*a,* a side and bottom wall forming station 10*b,* and a top curl forming station 10*c*. The curling tool 12 according to this invention is thus shown in accompanying FIG. 1 as being employed to form the bottom curl of the container side wall, but as will be appreciated it could likewise be employed as the top curl forming tool $\mathbf{10}c_3$, if desired.

The side wall blank-forming station 10*c* is provided with a blank-forming press $\mathbf{10}a_1$ which punches arcuate shaped side wall blanks SB from a roll $\mathbf{10}a_2$ of paperboard sheet stock. The side wall blanks SB are picked-up by a transfer turn-table $\mathbf{10}a_3$ which transfers the side wall blanks SB to the side and bottom wall forming station 10*b*. The bottom walls of the containers are punched from a roll of sheet paperboard sheet stock $\mathbf{10}b_1$ by means of bottom wall punch $\mathbf{10}b_2$ and are transferred to the bottom of the container-forming mandrels (a few of which are identified by reference numeral $\mathbf{10}b_3$) radially extending from the turn-table $\mathbf{10}b_4$. The container-forming mandrels $\mathbf{10}b_3$ will thereafter pick up one of the side wall blanks SB in sequence so that the side wall blanks SB are folded around the mandrel $\mathbf{10}b_3$. During this operation, the side seam and the circumferential bottom wall seam are glued to thereby create container preforms (i.e., containers which are complete except for the formation of the bottom and top curls around the container's bottom and upper edges, respectively).

The turntable $\mathbf{10}b_4$ will rotate in sequence each of the container preforms into registry with the curling tool 12 according to this invention. In this regard, the curling tool 12 is mounted for reciprocal linear movements towards and away from the bottom of the container preform by means of motor 12*a*. Thus, it its "downstroke" (i.e., in the direction toward the container preform bottom), the curling tool will form a bottom curl on the container preform as will be described in greater detail below.

Continued indexing of the turn-table $\mathbf{10}b_4$ will present each of the container preforms to individual holders $\mathbf{10}c_1$ radially associated with a transfer table $\mathbf{10}c_2$. The transfer table $\mathbf{10}c_2$ thereby sequentially transfers the container preforms to the top curl forming station 10*c* where the top curl forming mandrel $\mathbf{10}c_3$ reciprocally moves into registry with the top edge of the container preform by means of motor $\mathbf{10}c_4$. During the "down-stroke" of the top curl forming mandrel $\mathbf{10}c_1$ (i.e., during movement of the top curl forming mandrel $\mathbf{10}c_3$ in a direction toward the holder $\mathbf{10}c_1$), the top curl of the container is made. The now completed container will be rotated via turret $\mathbf{10}c_2$ so that it is indexed into registry with the pneumatic chute 28 continuously supplied with pressurized air via line 30. The completed container will thereby be transferred through chute 28 to a collection site (not shown) where a number of containers may be packaged and shipped to customers.

Figure 2:
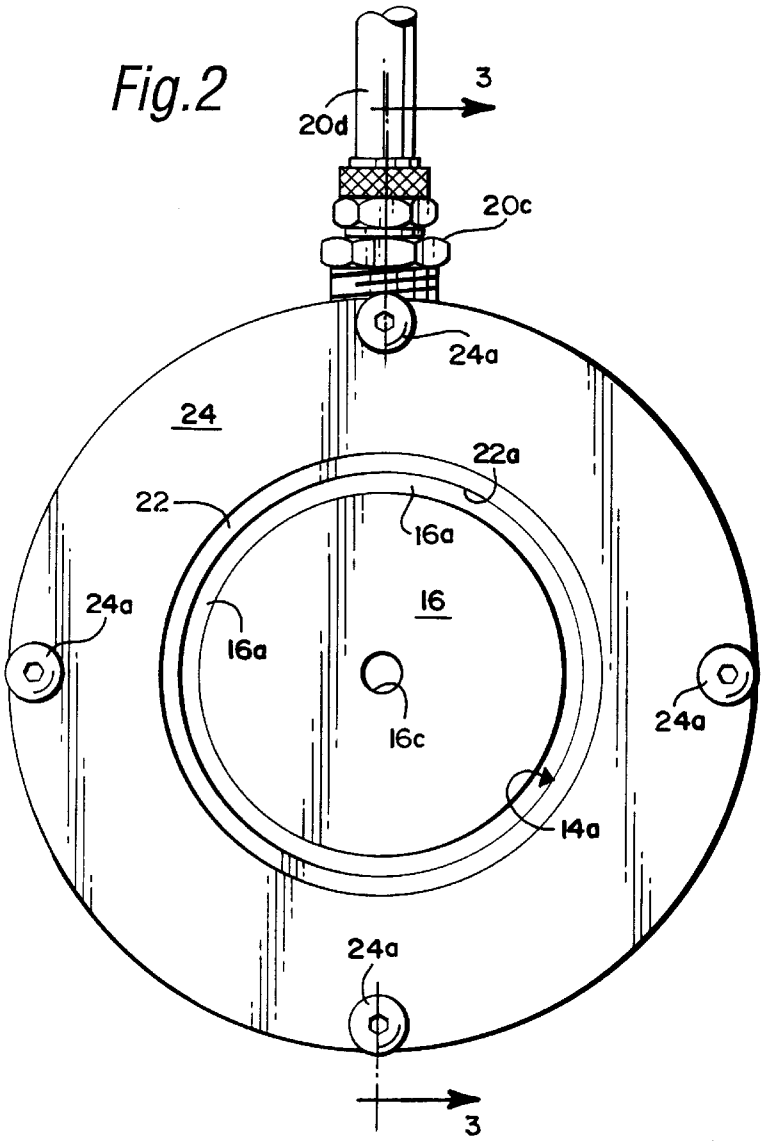
FIG. 2 is a top plan view of the container curling tool according to this invention.
Figure 3:
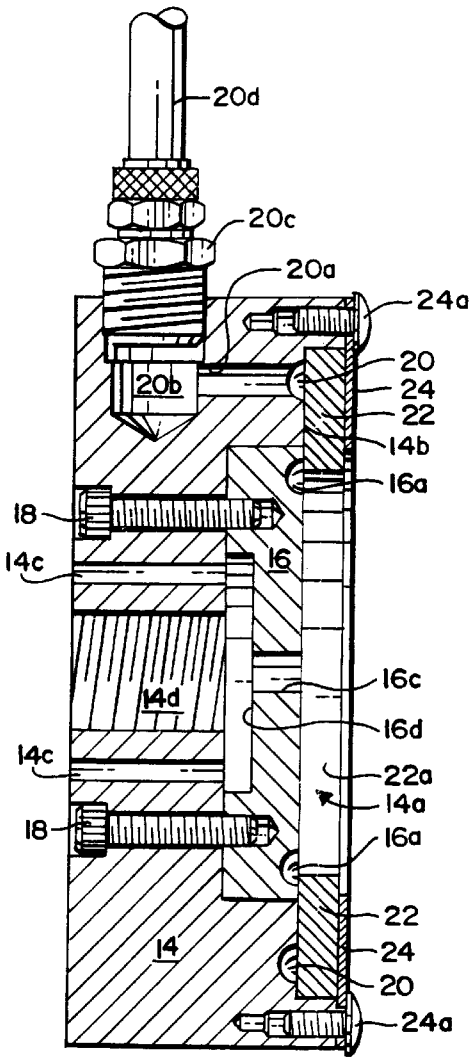
FIG. 3 is a cross-sectional elevational view of the container curling tool shown in FIG. 2 as taken along line 3—3 therein.

The structural components of the curling tool 12 according to this invention are perhaps best seen by reference to FIGS. 2 and 3. As shown therein, the curling tool 12 includes a housing block 14 which defines a container-receiving recess 14*a* in its forward face 14*b* (i.e., relative to the container bottom). A curl-forming insert 16 is rigidly mounted within the recess 14 by means of bolts 18 and defines an annular curl-forming arcuate recess 16*a*. A central opening 16*c* is also formed in the insert 16 and opens to a rear chamber 16*d* sized sufficiently so that fluid communication is established with vent channels 14*c* formed in the housing block 14 parallel and adjacent to the threaded coupling bore 14*d*.

The vent channels 14*c*, chamber 16*d* and opening 16*c* thus serve to collectively allow air to be vented to ambient environment during curl formation (i.e., to prevent air from being trapped in the recess 14*a* when the curl forming tool 12 is advanced into contact with the container bottom). In addition, the vent channels 14*c*, chamber 16*d* and opening 16*c* provide a path through which compressed air may be introduced to encourage transfer of the container from the mandrel 10*b* to a mandrel $\mathbf{10}c_1$ as shown in FIG. 1. The coupling bore 14*d*, on the other hand, serves to provide threaded connection with support structure (e.g., so as to allow for reciprocal linear movement of the curling tool 12 as described previously) and seals the chamber 16*d* thereby so that fluid ingress/egress occurs through the channels 14*c*.

Important to the present invention, the housing block 14 of the curling tool 10 also defines an annular channel 20 which concentrically surrounds the curl-forming channel 16*a*. A passageway 20*a* fluid-connects the channel 20 to an input port 20*b* to which a coupling 20*c* and its associated conduit 20*d* are attached. Lubricating fluid (e.g., food-grade mineral oil) is therefore supplied to the channel 20 via the fluid connection provided by conduit 20*d*, input port 20*b*, and passageway 20*a*.

An annular ring of porous felt or open-celled foam material forms a liquid transfer ring 22. The liquid transfer ring 22 is positionally held by the retaining ring 24 which is rigidly mounted via screws 24*a* to the housing block 14. The liquid transfer ring 22 is therefore positioned in covering relationship to the annular channel 20 and has an interior surface 22*a* which defines an opening which at least partially covers the curl-forming channel 16*a*. The liquid transfer ring 22 therefore is saturated by liquid (e.g., food-grade mineral oil) which is supplied to the channel 20.

Since the curl-forming channel 16*a* is at least partially covered by the liquid transfer ring 22, the bottom edge of the paperboard container side wall to be curled will first be brought into wiping contact with the saturated liquid transfer ring 22 before encountering the curl-forming channel 16*a*. In such a manner, therefore, the lubricating liquid saturating the transfer ring 22 will be transferred to only that region of the container side wall in need of the same—i.e., to the bottom edge of the side wall. Moreover, since lubrication via the liquid transfer ring will occur immediately prior to the curling operation via the bottom curl-forming channel 16*a*, that portion of the container side wall to be curled will be sufficiently lubricated so as to substantially minimize (if not eliminate entirely) damage to the container due to such an operation.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. Apparatus for lubricating and curling a rim of a paperboard container comprising:

a housing block defining a central recess sized and configured to accept therein a rim of a paperboard container to be curled;

an annular curling channel disposed in said recess for curling the rim of the paperboard container in response to relative advancing movement between the paperboard container and the housing block;

said housing block also defining an annular liquid channel concentrically disposed in surrounding relationship to said annular curling channel for distributing lubricating liquid; and a porous liquid transfer ring formed of a felt or open-celled foam material, said liquid transfer ring being attached to said housing block in covering relationship to said annular liquid channel so that lubricating liquid supplied to said liquid channel comes into contact with and saturates said liquid transfer ring;

said liquid transfer ring includes a circular edge surface which defines a central opening such that said liquid transfer ring extends partially over said curling channel, wherein the rim of the paperboard container comes into wiping contact with said central opening of said liquid transfer ring so that lubricating liquid is transferred thereto prior to the rim being curled in said curling channel.

2. The apparatus as in claim 1, further comprising a retaining ring secured to said housing block for positioning retaining said liquid transfer ring thereto.

3. The apparatus as in claim 1, further comprising at least one vent channel establishing fluid-communication between said recess and ambient environment.

4. The apparatus as in claim 1, wherein said housing block includes a rigid insert member which defines said curling channel.

5. The apparatus as in claim 4, wherein said housing block includes at least one vent channel, and wherein said insert member includes a central aperture in fluid-communication with said at least one vent channel.

6. The apparatus as in claim 5, wherein said insert member includes a rear chamber which establishes fluid-communication between said central aperture and said at least one vent channel.

7. The apparatus as in claim 6, wherein said housing block defines a pair of said vent channels.

8. The apparatus as in claim 1, wherein said housing block includes a liquid supply port in fluid-communication with said liquid channel for supplying liquid lubricant thereto.

9. The apparatus as in claim 8, wherein said housing block includes a supply channel which fluid-connects said liquid supply port and said liquid channel.

10. The apparatus as in claim 1, wherein said liquid channel has an arcuate cross-sectional shape.

11. The apparatus as in claim 1, wherein said housing block includes a threaded coupling for connection to support structure which allow for reciprocal movement of said housing block relative to the rim of the paperboard container to be curled.

12. A method of lubricating and curling a rim of a paperboard container comprising the steps of:

(a) effecting relative advancing movement between a housing block which defines a central recess having an annular curling channel and a rim of a paperboard container;

(b) saturating with a liquid lubricant a porous annular liquid lubricant transfer ring formed of a felt or open-celled foam material which partially extends over the curling channel;

(c) bringing the rim of the paperboard container during initial relative advancement between the housing block and the paperboard container rim into wiping contact with the annular liquid lubricant transfer ring saturated with the liquid lubricant so as to transfer liquid lubricant to the paperboard container rim prior to curling; and thereafter (d) bringing the lubricated rim of the paperboard container during further relative advancement between the housing block and the paperboard container rim into contact with the curling channel to cause the lubricated paperboard container rim to be curled thereby.

13. The method as in claim 12, which further comprises continuously supplying liquid lubricant to the annular liquid lubricant transfer ring.

14. The method as in claim 12, which further comprises venting trapped air during relative advancement between the housing block and the paperboard container rim to ambient environment.

15. The method as in claim 14, wherein said venting step includes directing the trapped air through at least one vent channel formed in the housing block.

16. The method as in claim 12, wherein step (a) is practiced by moving said housing block towards the paperboard container rim.

17. The method as in claim 16, wherein step (a) is practiced using a reciprocal motor.

* * * * *